US010292515B2

(12) United States Patent
Petersen et al.

(10) Patent No.: US 10,292,515 B2
(45) Date of Patent: May 21, 2019

(54) TRANSPORT BOX

(71) Applicant: TABLEBOX APS, København K (DK)

(72) Inventors: Sonny Petersen, Ølsted (DK); Lasse Johansen, København Ø (DK); Michael Rude Moncur, Søborg (DK); Mads Spur-Mortensen, København Ø (DK)

(73) Assignee: Tablebox ApS, Copenhagen K (DK)

( * ) Notice: Subject to any disclaimer, the term of this patent is extended or adjusted under 35 U.S.C. 154(b) by 0 days.

(21) Appl. No.: 14/892,564

(22) PCT Filed: May 12, 2014

(86) PCT No.: PCT/EP2014/059635

§ 371 (c)(1),
(2) Date: Nov. 19, 2015

(87) PCT Pub. No.: WO2014/187691

PCT Pub. Date: Nov. 27, 2014

(65) Prior Publication Data

US 2016/0106248 A1 Apr. 21, 2016

(30) Foreign Application Priority Data

May 22, 2013 (EP) ..... 13168738
Sep. 30, 2013 (DK) ..... 2013 70547

(51) Int. Cl.
*A47G 23/06* (2006.01)
*A47G 21/00* (2006.01)
(Continued)

(52) U.S. Cl.
CPC ..... *A47G 23/0608* (2013.01); *A47G 21/001* (2013.01); *B65D 5/02* (2013.01);
(Continued)

(58) Field of Classification Search
CPC ..... B65D 5/00; B65D 5/0015; B65D 5/008; B65D 5/02; B65D 5/0254; B65D 5/10;
(Continued)

(56) References Cited

U.S. PATENT DOCUMENTS 1,466,344 A * 8/1923 Sardou ..... B65D 5/2014 229/112
2,149,955 A * 3/1939 Burns ..... B65D 5/4608 229/117.16

(Continued)

FOREIGN PATENT DOCUMENTS

CN 1046136 A 10/1990
CN 2339502 Y 9/1999

(Continued)

OTHER PUBLICATIONS

International Search Report and Written Opinion, PCT/EP2014/059635, dated Sep. 10, 2014.

(Continued)

*Primary Examiner* — Robert Poon
(74) *Attorney, Agent, or Firm* — Winston & Strawn LLP

(57) ABSTRACT

A transport box configured for being transformable into a lap tray, which includes a compartment defined by opposite side walls, a front wall opposite a rear wall, and a bottom, with the walls delimiting an opening opposite the bottom for accessing the compartment, the opening having a circumferential edge which is defined by opposite upper edges of the side walls, an upper edge of the rear wall and an upper edge of the front wall, and a lid for the opening comprising at least a first lid part extending from the circumferential edge of the opening. The bottom has a front wall edge and a rear wall edge, which rear wall edge is shorter than the front wall edge, and the first lid part is configured for being folded or pivoted away from the opening in a transformed state of the transport box to serve as a lap tray.

13 Claims, 9 Drawing Sheets

(51) Int. Cl.

| | |
|---|---|
| ***B65D 5/02*** | (2006.01) |
| ***B65D 81/36*** | (2006.01) |
| ***B65D 5/468*** | (2006.01) |
| ***B65D 5/42*** | (2006.01) |

(52) U.S. Cl.
CPC ..... *B65D 5/029* (2013.01); *B65D 5/4266* (2013.01); *B65D 5/4608* (2013.01); *B65D 81/36* (2013.01)

(58) Field of Classification Search
CPC ..... B65D 5/103; B65D 5/106; B65D 5/2047; B65D 5/46088; B65D 5/46096; B65D 5/4608; A47G 23/0608
USPC ..... 229/111–112, 117.14
See application file for complete search history.

(56) References Cited

U.S. PATENT DOCUMENTS

| | | | | | |
|---|---|---|---|---|---|
| 4,171,763 | A * | 10/1979 | Card | B65D 5/46088 229/117.15 |
| 4,329,037 | A * | 5/1982 | Caviness | G03B 19/16 229/112 |
| 4,651,919 | A * | 3/1987 | Wischusen, III | B65D 5/46112 229/117 |
| 5,009,320 | A | 4/1991 | Kramer | |
| 5,127,339 | A | 7/1992 | Hood, Jr. | |
| 5,425,455 | A | 6/1995 | Miller et al. | |
| 9,415,997 | B2 * | 8/2016 | Coogan | B65D 77/0426 |
| 2009/0321503 | A1 | 12/2009 | Barnes et al. | |
| 2013/0034314 | A1 | 2/2013 | Peacock | |

FOREIGN PATENT DOCUMENTS

| | | | |
|---|---|---|---|
| CN | 202704060 | U | 9/1999 |
| DE | 202009011049 | U1 | 2/2010 |
| GB | 2436791 | A | 10/2007 |
| JP | H04-50621 | U | 4/1992 |
| JP | H05-92202 | U | 12/1993 |
| JP | H08-72854 | A | 3/1996 |
| NL | 1029764 | | 2/2007 |
| WO | 2013/126212 | A1 | 8/2013 |

OTHER PUBLICATIONS

Notification of Reasons for Refusal, Appl. No. JP 2016-514326, dated Jun. 11, 2018.

* cited by examiner

TRANSPORT BOX

This application is a 371 filing of International Patent Application PCT/EP2014/059635 filed May 12, 2014, which claims priority to Danish patent application PA 2013 70547 filed Sep. 30, 2013 and European patent application 13168738.6filed May. 22, 2013.

BACKGROUND

The present invention relates to a transport box configured for being transformable into a lap tray,

- the transport box comprises a compartment defined by opposite side walls, a front wall opposite a rear wall, and a bottom,
- said walls delimiting an opening opposite the bottom for accessing the compartment,
- the opening has a circumferential edge, which is defined by opposite upper edges of the side walls, an upper edge of the front wall and an upper edge of the rear wall, and
- a lid for the opening comprises at least a first lid part extending from the circumferential edge of the opening.

The present invention also relates to an insert for the transport box, blanks that are foldable into the transport box and the insert, a method of assembling the blanks and the insert, and uses of the transport box as a lap tray and for transporting one or more objects such as food and/or beverages.

Preferably the transport box is a food transport box, although other kind of objects may be quite as suited for use with the transport box.

Boxes for transporting objects such as e.g. food that are made from e.g. a foldable cardboard blank and are able to be positioned on top of the thighs of a seated user when consuming the food by opening the box, are well-known. However, in such a position the box could easily tilt or slide off the thighs of the user in case he moves his thighs, is seated inside a moving vehicle or accidentally pushed the box.

The art of folding a blank, i.e. a piece of e.g. cardboard or carton, into a box is well-known from the packaging industry. Generally, the blanks of the present invention can be made by cutting cardboard into desired shape and making the needed fold lines. The blanks could also be provided with a pleasant color or a logo via printing, embossing, via labels or combinations of these, and/or it could be laminated. The blanks are preferably shipped in the flat form, and afterwards folded and assembled into the final shape by a machine or by hand.

U.S. Pat. No. 5,127,339 discloses a foldable lap tray made from a corrugated cardboard blank. The top portion is provided with a circular hole for holding a cup and vertical flaps for counteracting objects from sliding off the tray. The tray is provided with bottom portions extending underneath the seated persons thighs and interlocked together for providing stability to the tray. However the top portion is only kept horizontal as long as the user does not move his thighs, which is not likely during the time period it takes to e.g. consume a burger and a beverage in a car or at a sporting event.

U.S. Pat. No. 5,425,455 discloses a foldable lap tray made from a corrugated cardboard blank, where the bottom of the tray is provided with inverted V-shaped support legs that the user can grip with his thighs in order to stabilize the tray when seated. However the thighs of a seated person may not be parallel, which means that the support legs do not follow the natural position of the thighs.

Thus, the known lap trays mentioned above do not provide an optimal stabilization of the tray. Furthermore, they do not provide means for ensuring that the food is kept on the tray, and they are not convertible from a transport box for transporting the food before the user is seated and begins consuming the food.

Hence there is a need for a transport box of the kind mentioned in the opening paragraph with means for providing stability and means for ensuring that objects, such as food, is kept on the tray when used as a lap tray by a seated user.

SUMMARY OF THE INVENTION

In a first aspect according to the present invention is provided a transport box that can be transformed into a lap tray.

In a second aspect according to the present invention is provided a lap tray with means for stabilizing the lap tray when positioned between the thighs of a user.

In a third aspect according to the present invention is provided a transport box having means for conveniently carrying the box.

In a fourth aspect according to the present invention is provided a lap tray having means for keeping the objects on the tray.

In a fifth aspect according to the present invention is provided a blank for manufacturing the lap tray, which blank does not take up substantial space during storage and transport, and which blank can be transformed immediate before use, and can be transformed back into a blank, or into a flattened condition.

In a sixth aspect according to the present invention is provided a method for assembling a transformable transport box.

In a seventh aspect according to the present invention is provided uses of the transformable transport box.

The novel and unique whereby these and other aspects are achieved according to the present invention consists in the fact that

- the bottom has a front wall edge and a rear wall edge, which rear wall edge is shorter than the front wall edge, and
- the first lid part is configured for being folded or pivoted away from the opening in a transformed state of the transport box to serve as a lap tray.

Within the context of the present invention the term "transport state" is to be understood as the three-dimensional configuration of the transport box when the lid closes the opening of the compartment.

The term "transformed state" is also a three-dimensional state or configuration of the transport box, but where the lid is opened by folding or pivoting lid part(s) away from the opening of the transport box to get access to the cavity of the compartment, in which transformed state the transport box can be used as a tray.

The rear wall is the wall of the compartment intended to be closest to a seated user, and the front wall is the wall intended to be closest to the knees of the seated user when the compartment is located between the user's legs. It should be understood that the "rear wall edge" is the edge of the bottom that extends into the rear wall, and that the "front wall edge" is the edge of the bottom that extends into the front wall. The rear wall edge and the front wall edge are connected via opposite side wall edges, so as to define the geometrical outline of the bottom. By "the rear wall edge is shorter than the front wall edge" is referred to the relation between the widths of said edges, in particular the width of the respective edge taken at the end points of the opposite side wall edges of the two opposite side walls. Thus within the scope of the present invention a rear wall edge and a side wall edge that are curved, convex and/or made as a broken-line are also contemplated. The side wall edges may also be more or less curved in various manner. The width of the rear wall edge can even be close to zero in which case the bottom can be substantially V-shaped, and the point at the apix of the V-shape constitutes the rear wall edge. The rear wall edge and the front wall edge may curve towards each other or away from each other. Similarly applies for the curvature of the side wall edges, which curvature can be the same or different. The essential feature is that the bottom is tapering from front to rear, so as to be wedge-shaped to impart on the compartment a tapering wedge-shape too. A V-shaped bottom is a special case of a wedge.

Other intermediate states between the transport state and the transformed state are possible states.

Accessible free space between the thighs of a seated person is most limited closest to the crotch. When the bottom has a rear wall edge that is shorter than the front wall edge, the compartment can, when held between the person's thighs, conveniently be positioned very close to the crotch of the person using the transport box as a lap tray, enabling said person to easily keep the compartment in place. The specially designed bottom confers to the compartment a convenient wedge-shape, which is particularly suited for placing said compartment on the free surface on which the person is sitting between the user's thighs or legs. So the compartment can rest firmly on a subjacent surface such as the seat of a chair or a bench, and can at the same time be accommodated between the thighs, so that the person using the transport box as a lap tray, does not need any extra space to the sides to put the objects he/she is using. The person using the transport box as a lap tray can, if required, easily exert an additional force on the side walls of the compartment by slightly squeezing his/hers thighs together to hold on to the compartment while still having the hands free for manipulating and handling the objects stored and transported inside the compartment in the transport state, or handling the objects in the compartment or put or resting on the lap tray obtained from the transformed transport box by pivoting or folding the first lid part away from the opening. Thus objects may be placed on the surface of the at least one first lid part that hygienically is facing the interior of the compartment when the lid is closed, and is protruding from the circumferential edge of the compartment's opening when the lid is open and transformed to a lap tray. Normally the compartment will rest firmly between the user's thighs even without application of force due to the novel design of the compartment, and of the novel design of the bottom in particular, which compartment mates or at least fits into the substantially V-shaped gap between the seated user's thighs. So the sitting user will be able to exert force on the side walls of the compartment by slightly squeezing his thighs together, so that the lap tray can be kept in place. This is especially useful for preventing the transport box from sliding away from its intended position. Even in the event that the user moves a bit from side to side the lap tray will move along following the users movements without substantial impact to the objects on the lap tray.

When referring to a person seated with the transport box between his thighs, it is assumed that the person has his legs positioned in a natural and convenient position with the knees moved apart, so that the gap between the thighs is substantially V-shaped, so that the compartment can easily be accommodated between the thighs of the user, instead of on top of the thighs. So the exterior shape of the compartment is configured to fit into said gap.

The lid is adapted to close the opening of the compartment in the transport state, which has the effect that the object(s), e.g. food, is kept safe inside the compartment, no external objects (such as rain drops, leaves etc.) can accidentally enter the compartment and contaminate the food, and the heat transfer to/from the compartment is reduced, which is important when the food e.g. is hot, such as a hot burger or a hot drink.

The first lid part extends from the circumferential edge of the compartment so that the user has easy and convenient access to the object(s) in the interior of the compartment via the opening when said opening is uncovered by folding or pivoting the at least one first lid part away.

The transport box may comprise at least a second lid part where the first lid part and the second lid part extend from different edge parts of the circumferential edge of the opening, to be folded or be pivoted to cover the opening.

In a preferred embodiment the lid may comprise at least one second lid part, where the at least one first lid part and the second lid part extend from respective opposite upper edges of the side walls and are configured for being folded or pivoted away from each other in a transformed state of the transport box, so that at least one of said lid parts, and preferably both said lid parts, can serve as the lap tray.

By folding the first lid part and the second lid part away from each other, e.g. into a substantial horizontal position in relation to the seat of the seated user, the transport box achieves the transformed state. The lid parts can e.g. extend substantially flush on opposite sides of the opening, to allow the lid parts to constitute one or two substantially horizontal tray surfaces to put e.g. the food or some of the food on when eating, while some of the food might be left in the compartment, i.e. the lid parts serve as a lap tray. It should be noted that the surfaces of the lid parts serving the tray function in the transformed state are hidden hygienically in the transport state.

These surfaces are e.g. facing the interior of the compartment or are brought together as a closed handle, and are first revealed to the exterior user environment as a lap tray when the first lid part and the second lid part are pivoted apart.

In an embodiment the size of the at least one first lid part and/or the at least one second lid part is adapted so that the lid part(s) in the transformed state extend over the width of the thighs of a seated average adult person, which reduces the likelihood of food (e.g. dressing from a burger) accidentally spilled during eating to land on the thighs of the person eating or on the surface on which the person is seated.

When referring to a person seated with the transport box between his thighs, legs or knees, it is to be understood that the person has his legs positioned in a natural and convenient V-shape so that the compartment can easily be accommodated between the thighs of the user and not on top of the thighs.

In an embodiment it is possible to transform the transport box between the transport state and the transformed state several times, which means that the user is able to open the box, manipulate its content, e.g. eat some of the food, close the box and possibly transport it to another location, and then continue manipulation. In case of warm (or cold) food, it is in this way possible to keep the food warmer (or colder) than if the box could not be re-closed.

In an embodiment at least a part of the respective opposite faces of the respective opposite side walls may diverge in the direction from the rear wall to the front wall. Accordingly, the compartment may comprise two opposite facing side walls having diverging faces. The degree of divergence of the side walls and the distance between the side walls are advantageously adapted so that the compartment fits between the thighs of an average person, e.g. a seated adult or child, and when at least a main part of the bottom of the compartment rests on the surface on which the person is seated, which makes it easier, safer and more convenient to hold the compartment by means of the thighs or without the means of the thighs if possible.

The bottom of the transport box may conveniently be just a single panel, but to allow the box to be flattened after use the bottom could in the alternative be composed of two or more bottom panel parts that are joined into the final shape of the bottom of the transport box.

In another embodiment the lid may comprise a third lid part extending from a top edge of the rear wall opposite a fourth lid part extending from the top edge of the front wall to improve closing of the opening.

Two opposite lid parts may conveniently be configured for being joined in a transport state to serve as a handle. The handle provides an easy and convenient way of grabbing hold of and transporting the transport box. By grabbing the upper part of the handle the hand(s) of the user is kept at a distance from the compartment itself, which means that the hand is subjected to less heat in case of hot food (and less cold in case of cold food) than if the hand had to be close to the compartment or on the compartment itself in order to grab the transport box.

These advantages of the handle are especially distinct when the two opposite lid parts have been joined to protrude from the compartment, e.g. in an upright direction, such as e.g. substantially vertical when the transport box is positioned on a horizontal surface.

Accordingly, the handle can be made by combining the first lid part with the second lid part, or by combining the third lid part with the fourth lid part.

Advantageously the interior angle between at least one of the side walls and the bottom of the compartment can be equal to or at least 45°, more preferred equal to or at least 75°, and most preferred is equal to or at least 90°.

The smaller interior angle the smaller is the opening of the compartment. So at an interior angle below 90° the area of the opening of the compartment is smaller than the area of the bottom of the compartment, which reduces the likelihood of objects accidentally falling out of the compartment and enables the person to exert a partly downwards force on the compartment via his thighs.

In an embodiment said interior angle is close to 90°, or indeed 90°, which means that the side walls of the compartment have a vertical disposition in relation to the bottom when the compartment rests on a horizontal surface.

The height of the side walls of the compartment preferably corresponds to the average height of the thighs of a seated average adult person, which has the effect that the opposite lid parts are able to rest on top of the thighs of the seated person while having a substantially horizontal orientation in which they are supported by the person's thighs. It must however be understood that the compartment can be fitted into any appropriate gap, and that the lid parts can be folded or pivoted away from each other to rest on surfaces surrounding the gap, hole or other cavity, whether such being made for the purpose, e.g. a depression dug in the sand on the beach or being an existing gap, hole or other cavity, e.g. in a baby carriage, garden table or similar. The height of the side walls, and thus the depth of the compartment, can e.g. be in the interval of between 5-30 cm, between 10-20 cm, e.g. about 15 cm to make embodiments suited for everybody, including children.

A horizontal orientation of the lid parts is desired in the transformed state, as it thus is possible for the user to put objects on the lid parts and minimize any horizontal movement of such objects, which e.g. could be food, a scorecard in case the person is watching a sporting event, or playthings of a child.

The shape of the bottom may be or appear substantially as a trapezoid, preferably an isosceles trapezoid. This truncated triangle defines the base plane and outline for the three-dimensional shape of the compartment. It should be noted that the shape of the bottom could also be a polygonal shape that provides the impression of an approximate truncated triangle. So "appear substantially as a trapezoid" also includes polygonal shapes that provide an overall triangular perception of shape. The rear edge and the front edge of the bottom may preferably be substantially parallel, but could in the alternative be arched to curve in same or different directions.

The cross-section of the compartment in a plane parallel to the bottom may have a substantially isosceles trapezoidal shape e.g. by virtue of a bottom having substantially same shape. Thus e.g. the horizontal cross-section of the compartment, when positioned on a horizontal surface, has a substantially isosceles trapezoidal shape. In this embodiment it is preferred that a rear wall is facing the seated person, a front wall opposite the rear wall is facing away from the person, where the front wall is wider than the rear wall.

The shape of the bottom or the cross-sectional shape of the compartment could even have other shapes, such as triangular, as well as the shape of any of the walls of the compartment could be e.g. curved, such as concave, convex, waved, etc., however in a particular convenient embodiment the compartment has a shape like a cheese triangle with cut-off tip.

The rear wall edge and the front wall edge are distanced from each other by the side wall edges and it is preferred that the rear wall edge and the front wall edge have lengths or widths that overlap each other, at least to some extent, seen in the plane of the bottom. In some embodiments the rear wall edge and the front wall can be of more or less off-set lengths. An end part of opposite rear wall edge and front wall edge may overlap but it is in most embodiments preferred that the width or length of the rear edge is so short that it's ends do not go beyond the ends of front wall edge.

Bottoms with a square outline, i.e. wherein all edges of the bottom have equal lengths and extend into each other via right angles, or bottoms with a rectangular outline are excluded from the present invention.

In one or many embodiments the above-mentioned substantially isosceles trapezoidal shape of the bottom or of the cross-section of the compartment is combined with an interior angle between the bottom of the compartment and the rear wall, front wall and the side walls of the compartment that is substantially 90°.

Even if one or both lid parts is/are oriented horizontally in the transformed state this does not prevent objects from sliding off the lid part if e.g. such objects are accidentally pushed by the user. Such an unwanted situation can however be prevented by providing at least one of the first lid part, the second lid part, the third lid part and the fourth lid part with at least one rim extending from at least a part of a free edge of the respective lid part at an angle out of the plane of the lid part, such as an angle in the interval of 90°±20°, or in the interval of 90°±15°, or in the interval of 90°±10°, or in the interval of 90°±5°, or 90°.

In one embodiment the at least one rim extends along all or substantially all of the free edges of the lid part. It is noted that the free edges of a lid part may comprise all its edges except the edge where the lid part is connected to the compartment.

The grabbing hold of and transportation of the transport box can be further facilitated when at least one of two opposite lid parts comprises an opening with a hinged flap to be folded or pivoted away for use of the opening as a handle for introducing more or less of the user's hand during transportation of the transport box. In the transport state the weight of the transport box is increased by the weight of the goods. So the transport box is configured to withstand the weight of the goods and adapted to easily carry the goods along, e.g. due to the provision of the handle opening in opposite lid parts.

The hinged flap may be adapted to cover the opening in the corresponding lid part in the transformed state of the transport box. Moreover the hinged flap may be movable between an open position for carrying the transport box in the transport state, and a closed position in the transformed state.

In one embodiment both lid parts can comprise an opening with a hinged flap, where the flaps are located opposite each other in the transport state.

Prior to closing the lid the hinged flaps can be bend inwards or otherwise away from the opening and thus define a hole through the handle in the transport state. By providing the hinged flaps at a convenient distance from the free edge of the lid parts is obtained the advantage that the user is able to grab around the part of the handle defined by the free edge of the lid parts and the hole through the handle, which allows the user to conveniently carry the transport box.

In the position of the opposite lid parts as a lap tray the hinged flaps may be situated in same plane as the surrounding remaining lid part and are able to be held at this position due to friction between the flap and the surrounding remainder of the lid part, thereby making the lid part able to functions as a continuous lap tray surface without a hole, which means that spillage through the lap tray is inhibited. The flap can e.g. be made by partly cutting a lid part.

In one embodiment the first lid part and the second lid part both include a top part hingedly extending from the circumferential edge of the opening of the compartment, and a handle part extending from the opposite edge of the top part, where the top part can be oriented protruding above the opening and the handle part be oriented substantially upright from the opening when the compartment rests on a horizontal surface in the transport state of the transport box.

In another embodiment the first lid part and the second lid part have neither openings nor hinged flaps, and are utilized as the lap tray in the transformed state of the transport box. This embodiment of a transport box according to the present invention further includes a third lid part and a fourth lid part extending from the circumferential edge of the opening alternating with the first lid part and/or the second lid part, where one of the third lid part and the fourth lid part has an opening with a hinged flap and the other of the third lid part and fourth lid part may have no hinged flap but just an opening for interlocking with the hinged flap in the transport state of the transport box. One of the third lid part and the fourth lid part may have a free end suitable to be fastened to e.g. the waist of the jeans of the user.

In a particular preferred embodiment of the transport box that is able to be stored in a space-saving manner in the three-dimensional transformed state at least one of the walls selected from the side walls, the rear wall and the front wall extends at an interior angle from the bottom that is larger than 90°, more preferably larger than 90° and up to 120°, e.g. larger than 90° and up to 110°, larger than 90° and up to 100°, larger than 90° and up to 95°, or from 92° to 95°, and most preferably e.g. 92° or 95°. In this configuration the compartment of a transformed transport box, where the first lid part, the second lid part, the third lid part and the fourth lid part are pivoted or folded away from the opening of the compartment, is able to be inserted into the compartment of another transformed transport box with the same or similar configuration. By stacking several of such transport boxes it is especially convenient and fast for a person at e.g. a restaurant to firstly place food or other objects into the compartment of the topmost transport box in such a stack of transport boxes, secondly close the lid, and thirdly remove the topmost and now ready-to-be-transported transport box.

Advantageously each of the side walls, the rear wall and the front wall extends at an interior angle from the bottom that is larger than 90°, more preferably larger than 90° and up to 120°, e.g. larger than 90° and up to 110°, larger than 90° and up to 100°, larger than 90° and up to 95°, or from 92° to 95°, and most preferably e.g. 92° or 95°. Naturally, the insert of the present invention may also be placed in the compartment during the first step.

Advantageously the transport box further comprises an insert being positionable inside the compartment at a position where its top wall is located at a distance from the bottom of the compartment and possible provided with one or more openings for holding a corresponding number of objects.

Raising the top wall of the insert from the bottom of the compartment has the effect that the wall of e.g. a drinking cup, at some distance from the bottom of the cup, is able to engage the wall of the opening of the insert, thereby preventing the cup from moving in the horizontal plane, so that the cup is held firmly in place in the opening of the insert but still protrudes sufficiently up beyond the insert in order for being conveniently grasped.

The opening of the insert is preferably circular, to receive a beverage of circular cross-section. The transport box can e.g. be used for transporting a typical fast food meal in the form of a burger wrapped in paper and a soft drink in a cup or can, in which case the burger can rest on the top wall of the insert and the opening of the insert can hold the cup or can. However, as such cups or cans typically are sold in different sizes, it is preferred to have a number of inserts with varying radii of said opening(s) of the top wall that can be positioned inside a compartment, and/or inserts configured to be positioned more or less close to the bottom of the compartment.

The vertical distance between the bottom of the compartment and the lid at the location of the circular opening of the insert could be chosen to correspond to the height of a drinking cup intended to be used, so that unintended vertical movement of the cup is also prevented.

In an embodiment the top wall of the insert has a shape, which is the same or corresponds to the shape of the bottom or the cross-sectional shape of the compartment, which e.g. can be a substantially trapezoidal shape or isosceles trapezoidal shape. The effect is that the food or objects are kept on the upper surface of the top wall of the insert.

The top wall of the insert is preferably raised from the bottom of the compartment by having at least one support member extending from the edge of the top wall at an angle of e.g. 90° or about 90° between the top wall and the support member.

In an embodiment the insert comprises one or more support members extending from the edge(s) of the top wall at an angle of e.g. 90° or about 90°, where substantially all of the circumference of the top wall is supported by said one or more support members in order to maintain the desired position of the top wall inside the compartment.

If the insert and the compartment has the substantially trapezoidal shape or isosceles trapezoidal shape, it may be expedient that the insert comprises one support member extending from each of the four edges of its top wall at an angle of e.g. 90° or about 90°, where substantially all of the circumference of the top wall is supported by these four support members in combination.

The at least one support member of any of the embodiments is preferably a support wall, and preferably of the same material as the top wall, but could also be a support pillar or some other kind of support member that is able to maintain the top wall in a raised position in relation to the bottom of the compartment.

The top wall of the insert may together with the support wall be frictionally or force-fittingly engaged inside the compartment.

For the embodiments where the interior angle between the bottom and the first side wall, the second side wall, the rear wall and the front wall is larger than 90°, it is preferred that the top wall of the insert is frictionally or force-fittingly engaged inside the compartment, and the top wall could preferably further comprise one or more support members (e.g. support wall or support pillar) extending from the top wall of the insert to the bottom of the compartment when the insert of positioned inside the compartment.

In a modified version the insert is a solid body provided with at least one upper recess, e.g. circular, for holding a corresponding number of objects, such as drinking cups. The at least one opening or recess of the insert could have other shapes than circular, such as e.g. rectangular or triangular.

In an alternative version of the embodiment where the top wall of the insert has a substantially trapezoidal or isosceles trapezoidal shape only one of the two parallel edges of the top wall is provided with at least one support member in order to raise said edge of the top wall from the bottom of the compartment, while the opposite of the two parallel edges is resting on the bottom of the compartment. This would naturally require that the material of the top wall is sufficient rigid in order not to bend due to the weight of the food to be placed on the insert.

In a modified embodiment of the present invention the lid comprises a first lid part and a second lid part extending from respective opposite upper edges of the side walls and configured for being folded or pivoted away from each other in a transformed state the transport box, where each of the first and second lid part defines an inner concave surface for placing on the thighs of a seated user in the transformed state of the transport box, and the first and second lid part curves towards each other in the transport state of the transport box to preferably serve as a handle. Due to the curved shape, each of the first and second lid part is provided with a concavity so that they in the transformed state are able to receive the thighs of a seated user, and thereby effectively protect the user's legs from e.g. food being spilled during eating. In this modified embodiment the lid preferably further comprises a fourth lid part extending from the upper edge of the front wall and having an elongated through-going slit, where said slit is positioned and dimensioned to receive a free upper front part of the first and second lid part. Thus, the first, second and fourth lid part can be joined and held together in the transport state, where the user may conveniently grab hold of the upper part of the first and second lid part, and possible also the upper part of the third lid part, to carry the table box. The lid of the modified embodiment preferably comprises a third lid part extending from the upper edge of the rear wall and dimensioned to cover the entire opening of the compartment, or at least most of the opening, in the transport state of the table box to reduce heat transfer between the interior of the compartment and the surroundings and to prevent unwanted object from falling into the compartment during transportation of the table box.

The features of the above described embodiments of transport boxes, inserts, lids and compartments can be combined to arrive to even further embodiments and designs.

The transport box according to the present invention can be made of several different blanks, examples of such are provided below, or can in some embodiments be molded as an integral unit for reuse.

Accordingly the transport box can advantageously be formed from a first blank comprising a number of panels interconnected via fold lines.

The panels for the transport box of the present invention may comprise:

- a rear wall panel connected to a front wall panel via one of two side wall panels,
- lid part panels extending from one side of any of the two side wall panels, and
- at least one bottom wall panel extending from the corresponding opposite side of any of the two side wall panels.

Such a blank does not take up much space when stored and can be folded into the three-dimensional shape of the transport box in good time prior to use, or just before use. Once the transport box has been used it can be folded back again into a flat structure for disposal, or be reused if not soiled.

The lid part panels may comprise at least two opposite tray panels, that serve the tray function as a lap tray in the transformed state of the transport box, and at least two handle wall panels, that serve the handle function in the transport state of the transport box.

In one embodiment the at least two opposite tray panels each include a respective handle wall panel so that the same lid part panel are utilized as both handle and lap tray depending on their spatial arrangement and position, thus have dual function. In this embodiment the tray panels are the first lid part and the second lid part of the transport box, respectively.

A first blank for a first embodiment of a transport box may more specifically comprise:

- a first side wall panel connected to the rear wall panel,
- a second side wall panel connected to the rear wall panel opposite the first side wall panel,
- a first bottom wall panel connected to the first side wall panel,
- a second bottom wall panel connected to the second side wall panel,
- a first top wall panel of a first lid part panel that is connected to the first side wall panel opposite the first bottom wall panel,
- a second top wall panel of a second lid part panel that is connected to the second side wall panel opposite the second bottom wall panel, a first handle wall panel of the first lid part panel that is connected to the first top wall panel opposite the first side wall panel, a second handle wall panel of the second lid part panel that is connected to the second top wall panel opposite the second side wall panel, and a front wall panel that is connected to the first side wall panel opposite the rear wall panel.

In this specific embodiment the first top wall panel and the first handle wall panel define the previously mentioned first lid part of the transport box, and the second top wall panel and second handle wall panel define the second lid part of the transport box, thus also the respective tray panels.

The top wall panels and handle wall panels serve the purpose of at least partly closing the opening of the compartment in the transport state of the transport box, where an example thereof is discussed in more details in connection with the drawings.

In the transport state and the transformed state the panels of the first blank have been folded into the transport box of the present invention.

In this embodiment of a folded first blank the first lid part and the second lid part, when in the transport state as a handle, protrude substantially from the compartment, which may be inconvenient for some persons.

A second embodiment of a first blank remedies the issue of the high handle in the transport state by providing two additional lid part panels that serves as the handle, namely the third lid part panel being the third lid part of the transport box and the fourth lid part panel being the fourth lid part of the transport box, respectively. In such an embodiment the handle wall panels are not included in the tray panels, which tray panels are separate lid part panels extending from the side wall panels.

More specifically for the second embodiment of a first blank, the first blank comprises:

a front wall panel inserted between the first side wall panel and the second side wall panel, a rear wall panel connected to the second side wall panel opposite the front wall panel, a first bottom wall panel connected to the first side wall panel, a second bottom wall panel connected to the second side wall panel, a first lid part panel connected to the first side wall panel opposite the first bottom wall panel, a second lid part panel connected to the second side wall panel opposite the second bottom wall panel, a third lid part panel connected to the rear wall panel opposite a third bottom wall panel, a fourth lid part panel connected to the front wall panel opposite a fourth bottom wall panel.

So the invention also proposes a second embodiment of a first blank, but emphasis is made that other embodiments of first blanks are intended within the scope of the present invention. The first embodiment and second embodiment are exemplary and should not be construed as limiting the present invention.

Any of the panels may be provided with appropriate connection means for securing the three-dimensional shape of the transport box.

In the first embodiment of a first blank the first bottom wall panel and the second bottom wall panel may be provided with first connection means for connecting the bottom wall panels to each other, the front wall panel and the second side wall panel may be provided with second connection means for connecting the front wall panel to the second side wall panel, the first and second top wall panels and the front wall panel may be provided with third connection means for releasable connecting the first to wall panel and the second top wall panel to the front wall panel, and the first and second handle wall panels may be provided with fourth connection means for releasable connecting the first handle wall panel and the second handle wall panel to each other.

In the transformed state the third connection means and the fourth connection means are not in use as the first blank can be partly unfolded, thus to serve as the lap tray as shown in the drawings.

In yet an alternative embodiment of the first blank, the bottom may be a single panel. For example the first bottom wall panel and the second bottom wall panel can be replaced with a single bottom wall panel, which is either connected to the first side wall panel where the first connection means is provided on the single bottom wall panel and the second side wall panel, or be connected to the second side wall panel where the first connection means is provided on the single bottom wall panel and the first side wall panel.

A preferred embodiment of the four connection means is further explained in connection with the drawings. However, other or additional kinds of connection means could be used, which e.g. could be an adhesive, glue, velcro or a snap-fit arrangement. It is however preferred or required that at least the third and fourth connection means provide a releasable type of connection.

With respect to the first embodiment of the first blank, the front wall panel could be connected to the second side wall panel opposite the rear wall panel, instead of being connected to the first side wall panel, in which case the second connection means connects the front wall panel to the first side wall panel.

In an embodiment of the first blank at least one of the lid part panels comprises at least one rim panel.

In order to prevent objects from sliding off one or both of the first lid part and the second lid part (defined by the top wall panels and handle wall panels) in the transformed state of the transport box, at least one of the first handle wall panel of the first lid part panel and the second handle wall panel of the second lid part panel advantageously comprises:

a first rim panel connected to the handle wall panel opposite the top wall panel, a second rim panel connected to the first rim panel opposite the handle wall panel, a third and fourth rim panel connected to opposite side edges of the handle wall panel, and a first and second tuck-in tab connected to the third rim panel and the fourth rim panel, respectively, where the second rim panel and the handle wall panel are provided with means for releasable assembling the first rim panel, the second rim panel, the third rim panel, the fourth rim panel, the first tuck-in tab and the second tuck-in tab into a rim extending from the handle wall panel.

When the first rim panel and the second rim panel are folded and assembled they can preferably be oriented substantially parallel, and the two tuck-in tabs can be tucked in between the first rim panel and the second rim panel, so that the first rim panel, the second rim panel, the third rim panel and the fourth rim panel form a non-interrupted rim. The means for releasable assembling the rim panels and the tuck-in tabs into a rim could e.g. be small flaps provided on the second rim panel for interlocking with correspondingly shaped cut-out holes in the handle wall panel, although other releasable assembling means such as an adhesive, glue, velcro or a snap-fit arrangement could also be used.

A preferably non-interrupted rim can be extending along all edges of the handle wall panel except along the edge where the handle wall panel is connected to the top wall panel.

In order to facilitate the carrying of the transport box, at least one of the first and second handle wall panels may comprise an opening with a hinged flap adapted to cover said opening.

The hinged flap is preferably created by making a cut and a fold line in the material of the handle wall panel at a convenient distance from the edge of the handle wall panel connected to the first rim panel. This means that the flap can be held in a closed position in the plane of the handle wall panel due to friction between the flap and the handle wall panel.

Preferably both handle wall panels comprises an opening with a hinged flap, said two openings being positioned opposite each other in the transport state of the transport box.

The openings and associated hinged flaps can be provided in the third lid part panel and the fourth lid part panel, optionally one hinged flap can be omitted to leave the opening free for engaging with the hinged flap on the opposite lid part panel when the transport box is in the transport state.

At least one of the first lid part panel and the second lid part panel may be without a corresponding top wall panel and/or just one of the first lid part panel and the second lid part panel may have at least one rim panel.

Some panels and/or connection means may in some embodiments of the transport box be glued together, in which case the transport box can be collapsed to a flat state rather than being completely unfolded to the first blank.

The insert of the transport box is advantageously formed from a second blank comprising a top wall panel having substantially the same shape and dimensions as the bottom or as a plane cross-section of the compartment made of the folded first blank, and at least one support panel connected to the top wall panel via a fold line, where the top wall panel optionally is provided with an opening. By "plane cross-section of the compartment" is here meant a cross-section taken in a plane parallel to the bottom.

In an embodiment the top wall of the second blank has at least one support wall connected to each of the four edges of the top wall via fold lines.

The second blank can be folded into its use configuration and back again to the blank configuration just as the not glued embodiments of the first blank.

The advantages of the insert formed from the second blank are the same as the previous mentioned advantages of the insert being positionable inside the compartment at a position where its top wall is located at a distance from the bottom of the compartment and is provided with at least one opening.

The transport box, the insert, the first blank and/or the second blank is/are preferably made from a foldable material, such as cardboard, carton or paper, but could also be made from another kind of foldable material, such as e.g. a plastic, metal or foam material. Blanks can conveniently be punched and fold lines indicated in the blank by depressions, lines or embossing.

The thickness of the foldable material is preferably selected so that it is easy to fold. The foldable material is preferably cheap and does not take up too much space in the completely unfolded state or collapsed state during storage, while the material at the same time is sufficient rigid to be able to maintain the desired shape of the transport box and lap tray.

The fold lines of the first and second blanks are provided in order to enable folding or pivoting of the wall panels in relation to each other, and are created using any conventional technique, e.g. by scoring the fold lines, embossment, depressing techniques, etc. The fold lines are preferably made so that the transport box has a build-in capability to assume the three-dimensional configuration of transportation state and transformed state of the transport box.

In the blank state the first blank and second blank are able to be stored and transported in a space-saving and thus cost-efficient manner, and then being folded into the transport box and insert on site when they are to be used.

The present invention also relates to a method of converting the first blank described above to a transformable transport box that can be folded and unfolded as occasion requires, alternatively collapsed or erected, as occasion requires.

The method of the present invention comprises the steps of:

- folding the panels of any of the first blanks of the present invention along the fold lines that connect said panels, and
- joining the panels of the first blank to a three dimensional transport box with a lid using one or more assembling means selected among any of the connection means, including but not limited to adhesive and/or glue.

In case the bottom is to be constructed of several bottom wall panels, these bottom wall panels can easily be joined by proper folding into e.g. a substantially trapezoid or isosceles trapezoidal shape to form the bottom of the transport box with a rear edge wall shorter than the front edge wall.

The panels of the first blank and/or the second blank may be joined in a completely releasable manner or partly releasable manner to enable conversion of the joined panels of the three-dimensional transport box and/or insert into the first/second blank or into a collapsed state of the first/second blank before or after use as a transport box and as a lap tray.

In use of the first embodiment of the transport box according to the present invention the first lid part panel and the second lid part panel constitutes the tray in the transformed state of the transport box and an upright handle in the transport state.

In use of the second embodiment of the transport box according to the present invention the first lid part panel and the second lid part panel constitute the tray in the transformed state of the transport box, and the third lid part panel and the fourth lid part panel constitutes the handle in the transport state. In this embodiment the first lid part panel and the second lid part panel are folded in overlapping relationship to cover the opening of the compartment at least in the transport state, in which transport state the third lid part panel and the fourth lid part panel are combined into a protruding handle that overlay the first lid part panel and the second lid part.

Irrespective of the design of the first blank and/or the second blank the transport box defines, in the transport state, an expedient closed compartment and a handle for transporting one or more objects, such as food and/or a drinking cup, and defines in the transformed state a lap tray for placing the objects on while the wedge-shaped compartment are situated on a subjacent surface, e.g. in the gap between a sitting persons thighs.

The transport box of the present invention is also suited for being used as a lap tray in a moving vehicle, such as e.g. a car, bus or train.

Instead of being adapted to an average adult person, the shape/dimensions of the lid parts, the distance between the two opposite side walls of the compartment, and the height of the side walls of the compartment can be adapted to e.g. an average child.

Accordingly, although some sizes may be preferred the transport box of the present invention is not limited to any size. The side walls can have any suited size and curvature to fit many thigh thicknesses and persons, the distance between the rear edge and the front edge can be more or less long, and the degree of tapering of the compartment, thus the diverging degree of the side walls, can be adjusted to a specific user group or a specific purpose.

Increased friction between the outer surface of the side walls of the compartment and the thighs of the user can be obtained by e.g. providing at least a part of said outer surfaces with a layer of a material that has this ability.

BRIEF DESCRIPTION OF THE DRAWINGS

The invention will be explained in greater detail below, describing exemplary embodiments of the transport box, the insert, the first blank and the second blank according to the invention with reference to the drawings, in which.

DETAILED DESCRIPTION OF THE INVENTION

Figure 1:
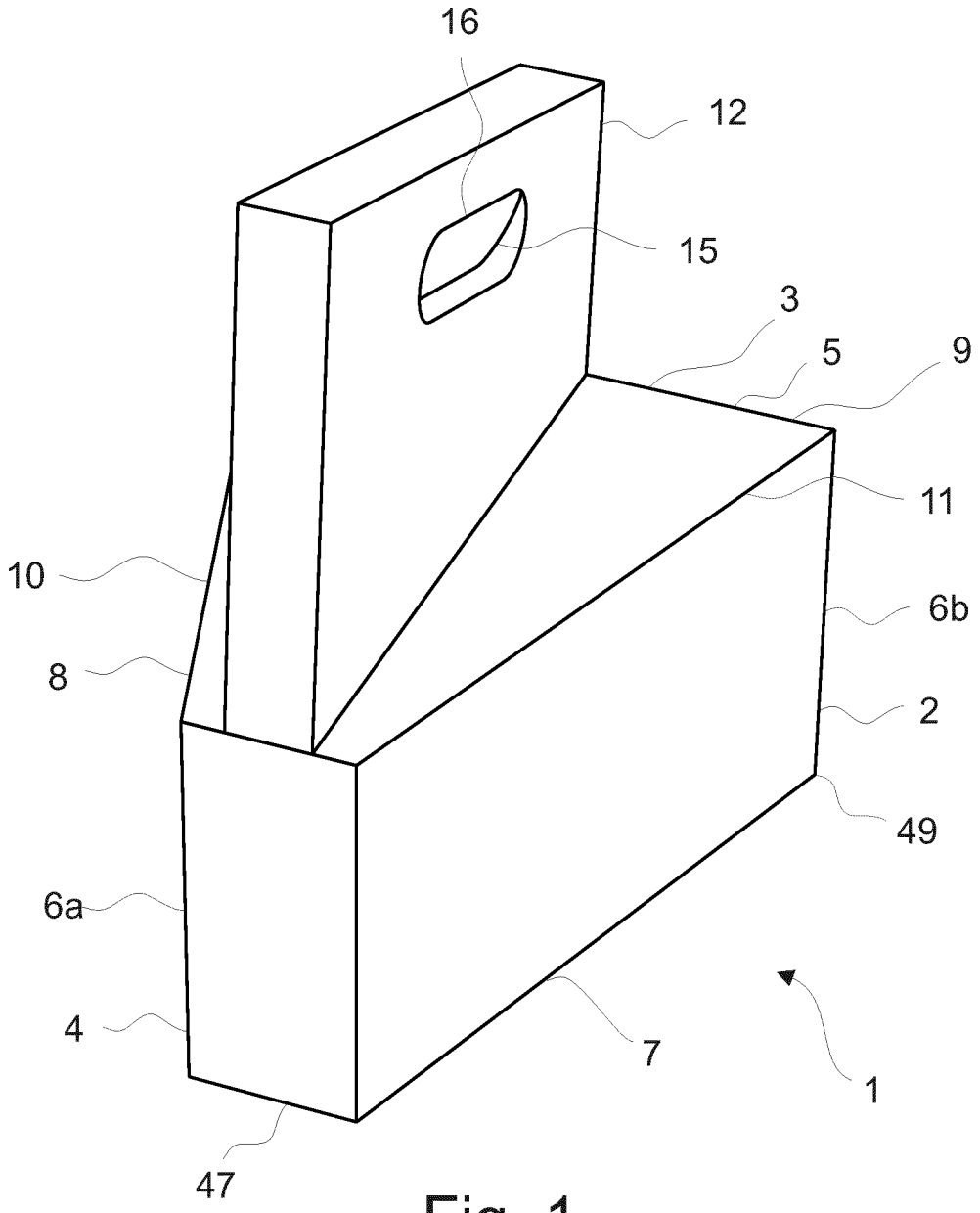
FIG. 1 shows, seen in perspective from a short rear wall, a first embodiment of a transport box according to the present invention in its transport state.

The invention is described in the drawings under the assumption that—seen in relation to a horizontal surface on which the compartment is placed—the side walls of the compartment have a vertical disposition, the horizontal cross-section of the compartment has an isosceles trapezoidal shape, and the rim of the lid parts has a vertical disposition in relation to the corresponding lid part. However, other dispositions of the side walls, degrees of tapering of the side walls towards each other, other shapes of the horizontal cross-section of the compartment and of the bottom, and/or other dispositions of the rim of the lid parts that are able to provide the intended technical effects of the overall invention are intended within the scope of the present invention.

The invention is also described in the drawings under the assumption that the transport box is for transporting food and a drinking cup. However, other kinds of objects could also be transported in the transport box of the present invention.

FIG. 1 shows the first embodiment of a transport box 1 having a compartment 2 and a lid 3. The shape and mutual position of the rear wall 4, the front wall 5, the first side wall 6*a*, the second side wall 6*b*, and the tapered bottom 7 of the compartment 2 define the isosceles trapezoidal shape of its cross-section. The rear wall edge 47 of the bottom 7 is shorter than the front wall edge 49 of the bottom 7.

The lid 3 has a first lid part 8 hingedly and pivotably extending from the top edge 10 of the first side wall 6*a*, and an opposite second lid part 9 hingedly and pivotably extending from the top edge 11 of the second side wall 6*b*.

The first lid part 8 and the second lid part 9 will be described in more details in connection with FIG. 2. However, as illustrated in FIG. 1 the lid parts 8,9 extend into and define an upright handle 12 (the upright part of the first lid part 8 is not visible in FIG. 1) that a user can grab hold on and thereby conveniently carry the first embodiment of a transport box 1. The second lid part 9 is shown with its swing flap 15 hingedly extending from an inside edge 16 of the second lid part 9 and in a position between the open and closed position of the swing flap 15.

Figure 2:
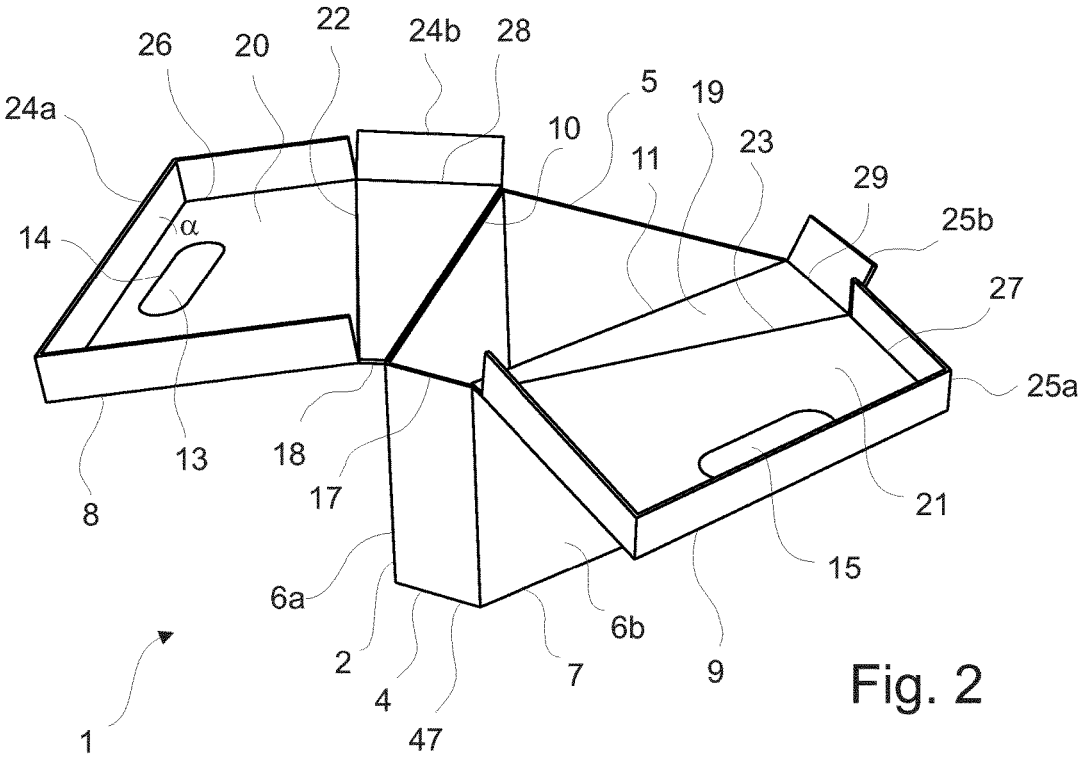
FIG. 2 shows the same in its transformed state as a lap tray.

FIG. 2 shows the transport box 1 in the transformed state, where the user via the opening 17 of the compartment 2 has access to the objects, such as food (not shown), located in the compartment 2. This access is obtained as the first lid part 8 and the second lid part 9 have been folded or pivoted away from each other.

The top wall 18 and the handle wall 20 of the first lid part 8, as well as the top wall 19 and the handle wall 21 of the second lid part 9 are shown in the position where they are substantially horizontal, and thus able to function as a lap tray in combination with the compartment 2.

In the transformed state the compartment 2 is intended to be positioned between, optionally be held in place by, the thighs of the seated user, with the rear wall 4 touching or at least located close to the crotch of the user, and where the first lid part 8 is extending over the left thigh of the seated user and the second lid part 9 is extending over the right thigh of the seated user.

The first lid part 8 has a first top wall 18 hingedly extending from the top edge 10 of the first side wall 6*a*, a first handle wall 20 extending from an inside edge 22 of the first top wall 18, an upright rim 24*a* extending from the free edges 26 of the first handle wall 20, an upright rim 24*b* hingedly extending from the front edge 28 of the first top wall 18, and a first swing flap 13 hingedly extending from an inside edge 14 of the first handle wall 20.

The second lid part 9 has a correspondingly second top wall 19, hingedly extending from the top edge 11 of the second side wall 6*b*, a second handle wall 21 extending from an inside edge 23 of the second top wall 19, an upright rim 25*a* extending from the free edges 27 of the second handle wall 21, an upright rim 25*b* hingedly extending from the front edge 29 of the second top wall 19, and a second swing flap 15 hingedly extending from an inside edge 16 (not visible) of the second handle wall 21.

The upright rims 24*a*,25*a* of the handle walls 20,21 are arranged at an interior angle α of substantially 90° with respect to the handle walls 20,21, as will be described in connection with FIG. 6. The upright rims 24*b*,25*b* of the top walls 18,19 are able to bend with respect to the top walls 18,19, but will assume an interior angle α of substantially 90° (or close to) 90° with respect to the top walls 18,19 due to the build-in capability of the material to assume the intended three-dimensional form. For illustrative purposes as to foldability the upright rims 24*b*,25*b* of the top walls 18,19 are not shown with their intended interior angle of 90° with respect to the top walls 18,19.

The swing flaps 13,15 are shown in their closed position where they are parallel with the surface of the handle walls 20,21.

Figure 3:
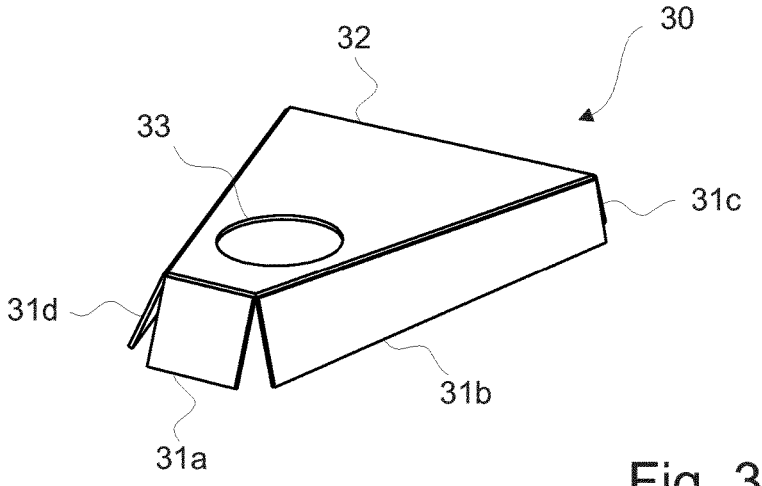
FIG. 3 shows, seen in perspective from a short rear wall, one embodiment of an insert for the transport box according to the invention.

FIG. 3 shows a first embodiment of an insert 30 that can be placed at the bottom of the compartment 2 via the opening 17 of the compartment 2. The insert 30 has four support members 31*a*,31*b*,31*c*,31*d* (shown in the form of support walls) hingedly extending from its top wall 32, which has a circular opening 33 for holding e.g. a drinking cup. The edges of the top wall 32 are intended to touch the rear 4, the front 5 and the side walls 6*a*,6*b* of the compartment 2.

The intended angle between each of the four support members 31*a*,31*b*,31*c*,31*d* in relation to the top wall 32 when the insert is placed in the compartment is 90°. Only for illustrative purposes FIG. 3 does not show this angle. However, with this intended angle it is easily understood that the top wall 32 is raised from the bottom of the compartment 2 and the insert 30 can rest stable on the bottom of the compartment 2 or be in frictional engagement with the interior surface of the compartment.

Figure 6:
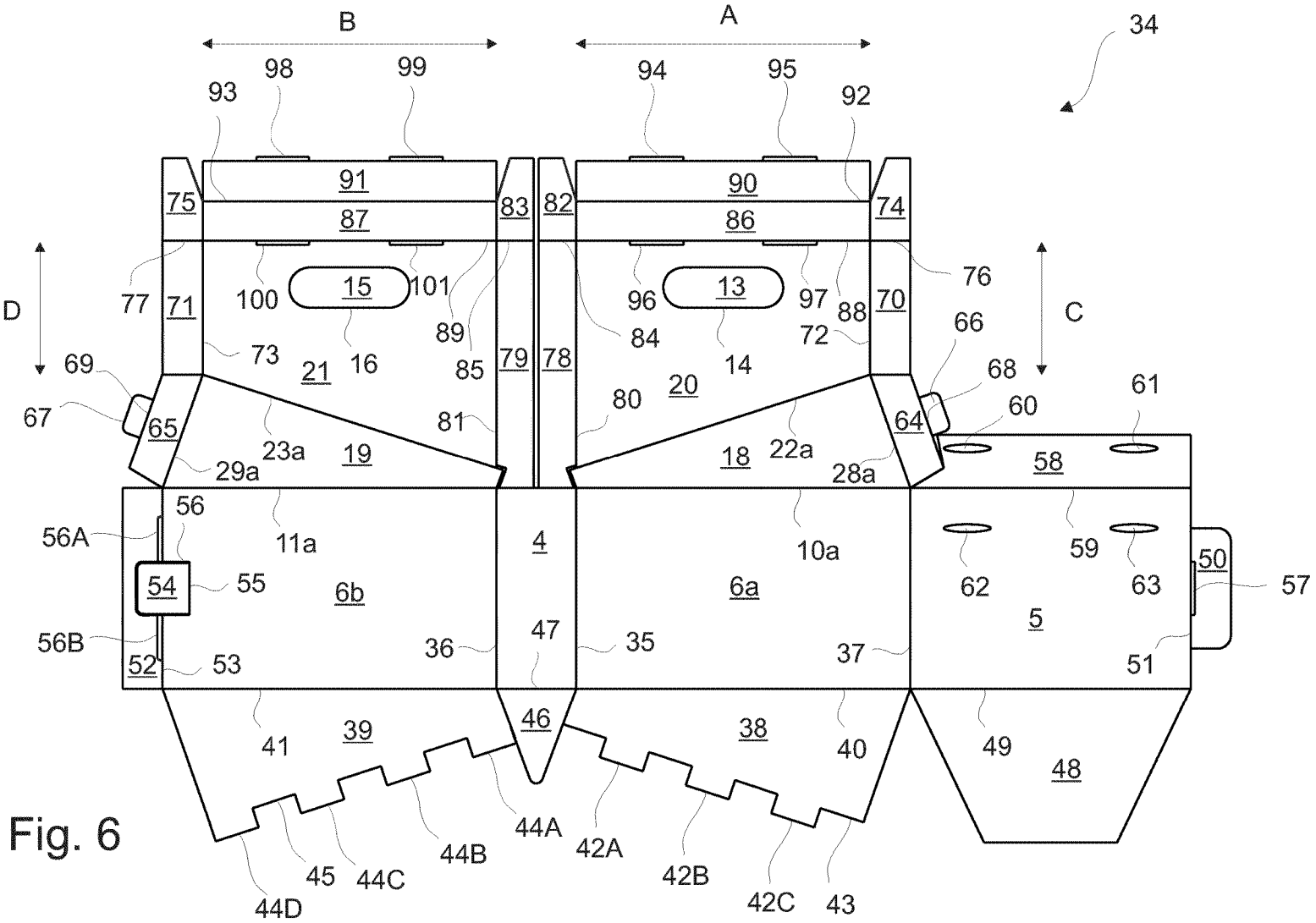
FIG. 6 shows a first embodiment of a first blank according to the invention.

It is noted that the height of the first support member 31*b* and the second support member 31*d* increases towards the end of the top wall 32 where the circular opening 33 is located, and that the height of the rear support member 31*a* is higher than the height of the front support member 31*c* (more clearly shown in FIG. 6). This variation in the height of the support members 31*a*,31*b*,31*c*,31*d* causes the top wall 32 to be tilted, so that food or other objects located on the top wall 32 will tend to be moved away from the drinking cup in case e.g. the transport box 1 is moved around. Separation of the drinking cup from the food/objects is desirable in order to e.g. minimize any heat transfer between the typically cold drinking cup and any warm food.

Figure 4:
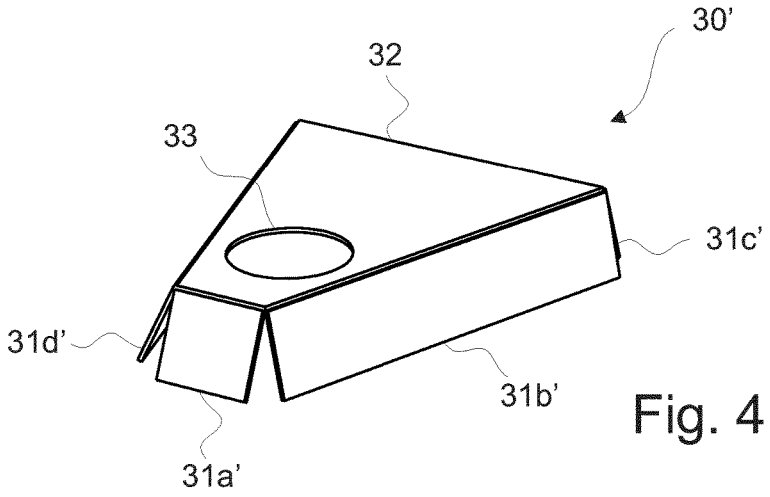
FIG. 4 shows, seen in perspective from a short rear wall, another embodiment of the insert of the transport box according to the invention.

FIG. 4 shows an alternative embodiment of the insert 30' where the support members 31*a*',31*b*',31*c*',31*d*' have the same height.

Figure 5:
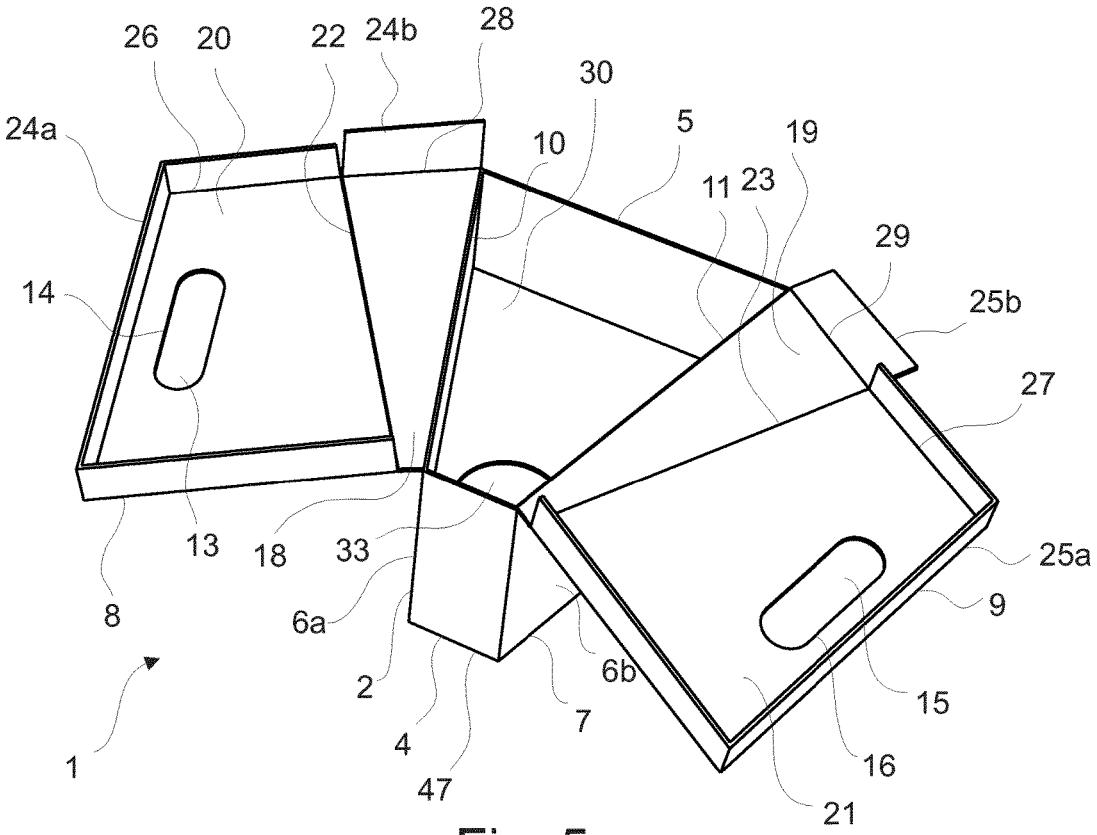
FIG. 5 shows, seen in perspective from a short rear wall, the transport box of FIG. 2 and the insert of FIG. 3, where the insert is positioned inside the compartment.

FIG. 5 shows the insert 30 seen in FIG. 3 positioned inside the compartment 2 of the transport box 1 shown in FIG. 1, where the support members 31*a*,31*b*,31*c*,31*d* are resting on the bottom of the compartment 2.

The terms left, right, rear, front, top and bottom used in the below description of the first and second blank 34,102 as shown in FIGS. 4 and 5 refer to the orientation of the first and second blank 34,102 when folded as shown in FIGS. 1 and 2.

FIG. 6 shows the first blank 34 in its unfolded and flat state. To facilitate reading and understanding of the conversion of the blank into a transport box same reference numerals are used for same parts being walls in the three-dimensional state as for wall panels in the blank state where possible. The first side wall 6*a* and the second side wall 6*b* extend as panels into the rear wall panel 4 via the opposite first fold line 35 and second fold line 36, respectively. The front wall panel 5 extends via the third fold line 37 into the first side wall panel 6*a*.

The first bottom wall panel 38 extends via the fourth fold line into the first side wall panel 6*a*, and the second bottom wall panel 39 extends via the fifth fold line 41 into the second side wall 6*b*. In the embodiment shown in FIG. 6 the first connection means consists of three protruding flaps 42*a*,42*b*,42*c* extending from the interior edge 43 of the first bottom wall 38 and four protruding flaps 44*a*,44*b*,44*c*,44*d* extending from the interior edge 45 of the second bottom wall panel 39, where the flaps 42*a*,42*b*,42*c*,44*a*,44*b*,44*c*,44*d* are arranged so that when the two bottom wall panels 38,39 are brought together upon folding of the transport box 1 the flaps 42*a*,42*b*,42*c*,44*a*,44*b*,44*c*,44*d* are bend a bit upwards so that the flaps 42*a*,42*b*,42*c* of the first bottom wall panel 38 overlaps the second bottom wall panel 39, and vice versa. In this way the bottom wall panels 38,39 are able to engage each other in an interlocking manner.

The first blank 34 has a rear bottom wall panel 46 extending via the sixth fold line 47 into the rear wall panel 4, and a front bottom wall panel 48 extending via the seventh fold line into the front wall panel 5, where the rear bottom wall panel 46 and the front bottom wall panel 48 in the folded state of the transport box 1 are positioned over the first bottom wall 38 and the second bottom wall 39. This has the effect that there is no gap between the first/second bottom wall 38,39 and the rear/front wall 4,5 in the folded state, which inhibits e.g. liquid food from running down along the rear wall 4 or front wall 5 and through any small gap between the rear/front wall and the bottom walls 38,39.

In the embodiment shown in FIG. 6 the second connection means consists of the flap 50 extending from the front wall panel 5 via the eighth fold line 51, the flap 52 extending from the second side wall panel 6*b* via the ninth line 53 on the front side of the second side wall panel 6*b*, and the flap 54 hingedly extending via the tenth fold line 55 from the second side wall panel 6*b*. The flap 54 is made by performing a U-shaped cut 56 partly in the second side wall 7 and partly in the flap 52 as shown in FIG. 6.

After the bottom wall panels 38,39 has been connected as described above, the flap 52 is bend into an angle parallel with the front wall 5 in its the folded state, the flap 50 is inserted into the slit created due to the cuts 56*a*,56*b* performed in the flap 52, and the flap 54 is afterwards bend into the slit created due to the cut 57 performed in the flap 50. In this way the front wall 5 and the second side wall panel 6*b* are releasably connected to each other.

A flap 58 is extending via the eleventh fold line 59 into the front wall panel 5 and is provided with two cut-out holes 60,61. The flap 58 is bend inwards into a position parallel with the front wall panel 5, which is provided with two cut-out holes 62,63 placed opposite the holes 60,61 of the flap 58 as shown in FIG. 6.

The first top wall 18 and the second top wall 19 are extending via the twelfth fold line 10*a* into the first side wall panel 6*a* and via the thirteenth fold line 11*a* into the second side wall panel 6*b*, respectively. The first top wall panel 18 extends via the fourteenth fold line 28*a* into the first flap 64, and the first flap 64 extends via the fifteenth fold line 68 into the second flap 66. The second top wall panel 19 extends via the sixteenth fold line 29*a* into the first flap 65, and the first flap 65 extends via the seventeenth fold line 69 into the second flap 67.

The next folding step is to fold the first top wall panel 18 and the second top wall panel 19 over the opening 17 of the compartment 2 and inserting the left second flap 66 into the left holes 60,62 and the right second flap 67 into the right holes 61,63.

In the embodiment shown in FIG. 6 the third connection means consists of the first flaps 64,65 and the second flaps 66,67 and the cut-out holes 60,61,62,63.

The first handle wall panel 20 and the second handle wall panel 21 extend from the first top wall 18 and the second top wall 19, respectively, via the eighteenth fold line 22*a* and the nineteenth fold line 23*a*, respectively. Each of the handle wall panels 20,21 has a front flap 70,71 extending from the handle wall 20,21 via the twentieth fold line 72 and twenty-first fold line 73, respectively, where each of the front flaps 70,71 has a tuck-in tab 74,75 extending from the front flap 70,71 via the twenty-second fold line 76 and twenty-third fold line 77, respectively. Each of the handle wall panels 20,21 also has a rear flap 78,79 extending from the handle wall panels 20,21 via the twenty-fourth fold line 80 and twenty-fifth fold line 81, respectively, where each of the rear flaps 78,79 has a tuck-in tab 82,83 extending from the rear flap 78,79 via the twenty-sixth fold line 84 and the twenty-seventh fold line 85, respectively. Finally, each of the handle wall panels 20,21 has a first top flap 86,87 extending from the handle wall 20,21 via the twenty-eighth fold line 88 and the twenty-ninth fold line 89, respectively, where a second top flap 90,91 is extending from each of the first top flaps 86,87 via the thirtieth fold line 92 and the thirty-first fold line 93, respectively.

The upright rim 24*a* of the first handle wall 20 is obtained by folding the front flap 70 and the rear flap 78 into a position perpendicular to the handle wall panel 20, and folding the tuck-in tabs 74,82 into a position parallel with the twenty-eighth fold line 88 from which the first handle wall panel 20 extends. The front flap 70 and the rear flap 78 and the tuck-in tabs 74,82 are held in this position by firstly folding the first top flap 86 into a position perpendicular to the handle wall panel 20, secondly folding the second top flap 90 into a position parallel with the first flap 86, where the tuck-in tabs 74,82 are positioned between the first top flap 86 and the second top flap 90, and thirdly inserting the small flaps 94,95 of the second top flap 90 into the correspondingly shaped cut-out holes 96,97 in the handle wall panel 20. In this way the rear flap 78, the front flap 70, the first top flap 86 and the second top flap 90 are interlocked and form the upright rim 24*a* shown in FIGS. 2 and 5.

The upright rim 25*a* of the second handle wall 21 is, in the same way, obtained by folding the rear 79, the front 71, the first flap 87 and the second flap 91, folding the tuck-in tabs 75,83 and interlocking them using the small flaps 98,99 and the cut-out holes 100,101.

As the length A and height C of the first handle wall 20 is slightly smaller then the length B and height D of the second handle wall 21, respectively, the first handle wall 20 and its upright rim 24*a* is able to fit into the second handle wall 21 and its upright rim 25*a* when the transport box 1 is in its transport state. These lengths A,B and heights C,D are adapted so that the there is friction between the upright rims 24*a*,25*a*, where this friction holds the first handle wall 20 and the second handle wall 21 together, and thus forms the upright handle 12 shown in FIG. 1. Thus, the upright rims 24*a*,25*a* with the length/height difference constitutes the fourth connection means of the embodiment shown in FIG. 6.

Figure 7:
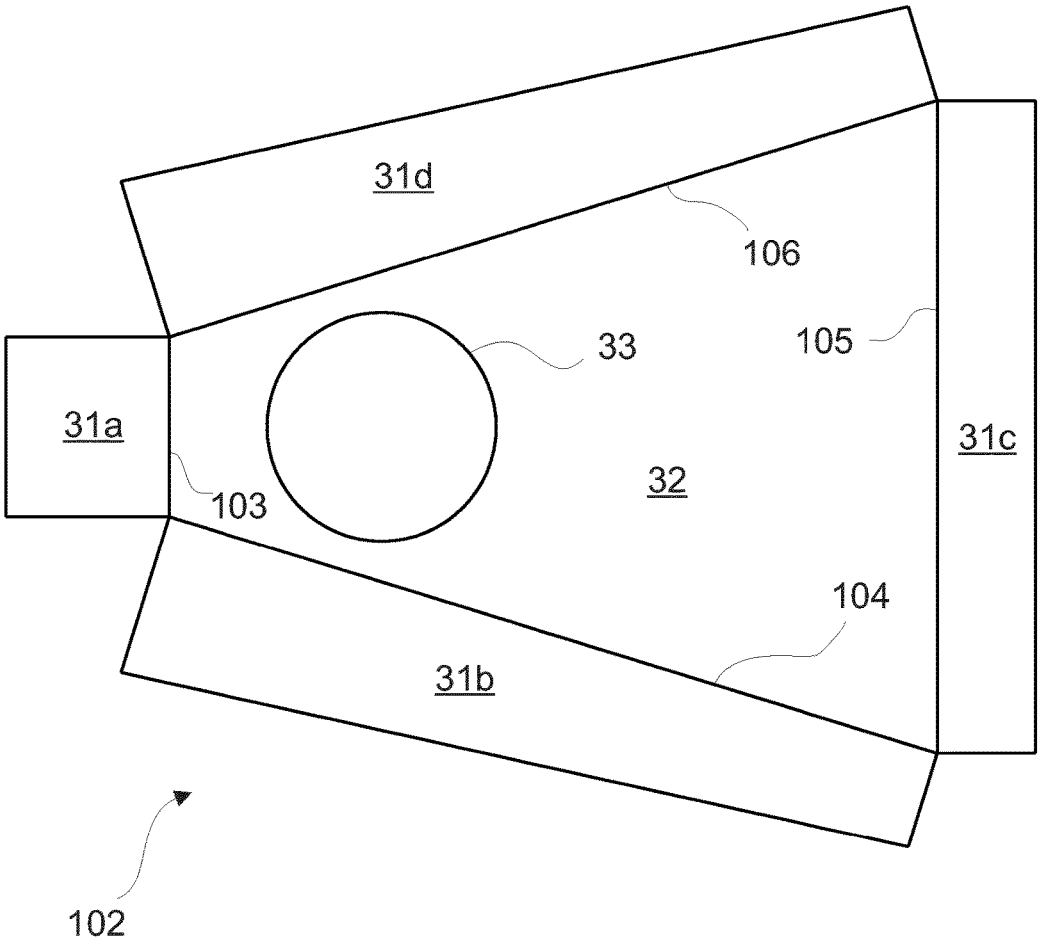
FIG. 7 shows a second blank according to the invention.

FIG. 7 shows the second blank 102 in its unfolded and flat state, where the top wall panel 32 has a circular opening 33, and each of the support wall panels 31*a*,31*b*,31*c*,31*d* extends from the top wall 32 via a respective top fold line 103,104, 105,106.

Figure 8:
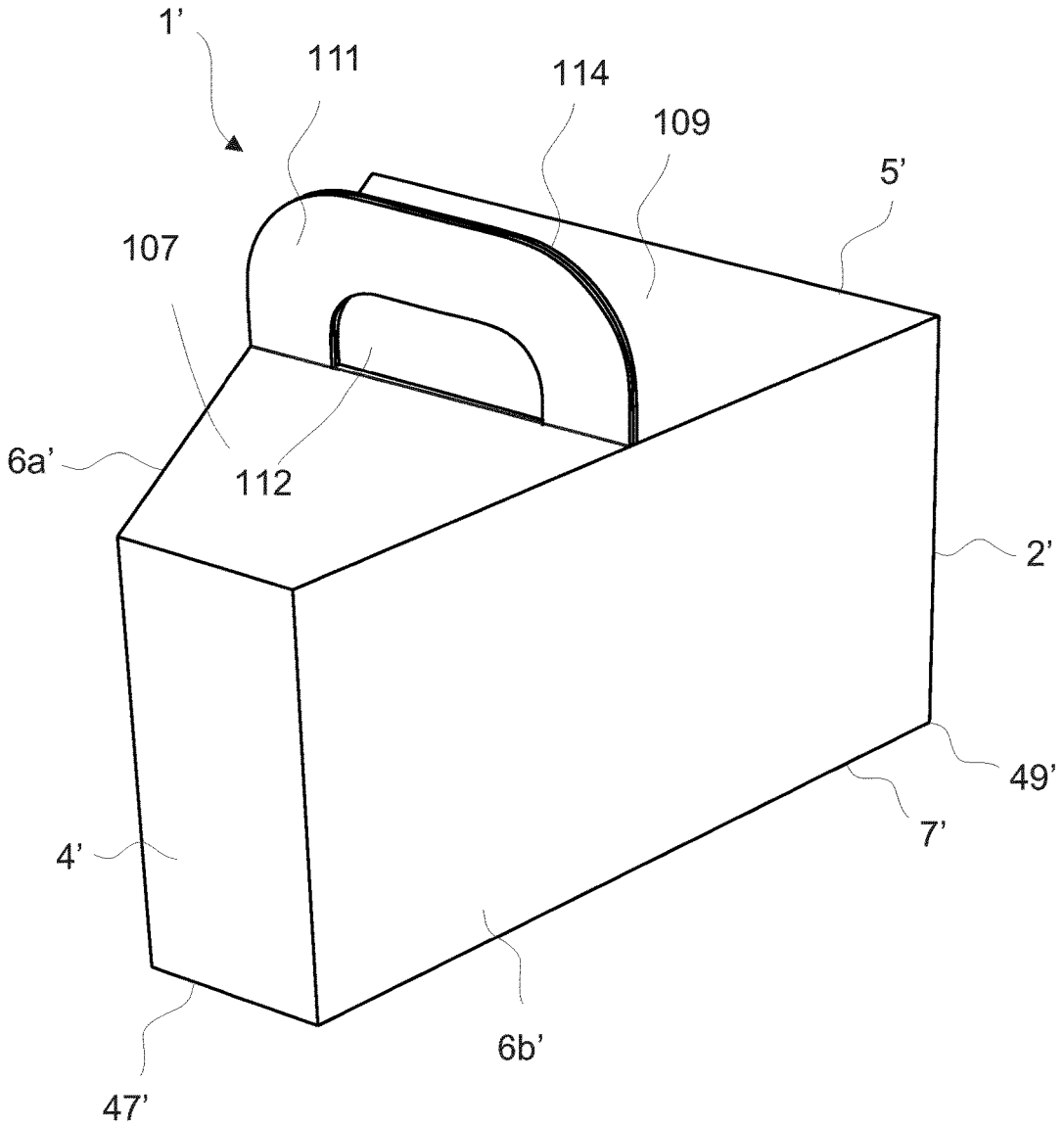
FIG. 8 shows, seen in perspective from a short rear wall, a second embodiment of a transport box according to the present invention in its transport state.
Figure 9:
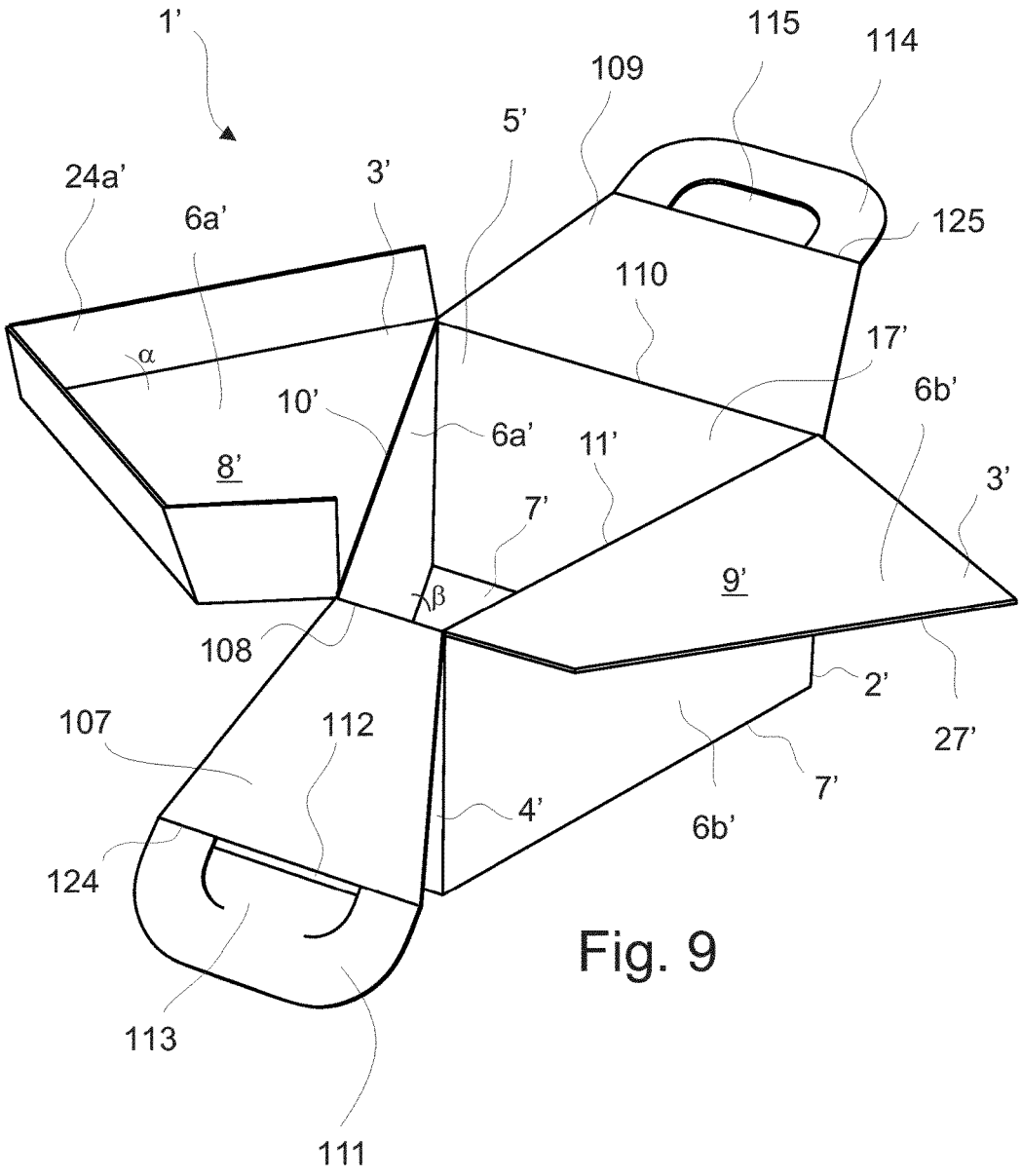
FIG. 9 shows the same in its transformed state as a lap tray.

FIGS. 8 and 9 show a second embodiment of a transport box 1' according to the present invention.

The second embodiment of the transport box 1' has a compartment 2' and a lid 3'. The shape and mutual position of the rear wall 4', the front wall 5', the first side wall 6*a*', the second side wall 6*b*', and the tapered bottom 7' of the compartment 2' define a wedge-shaped compartment 2' with a trapezoid opening 17'. The rear wall edge 47' of the bottom 7' is shorter than the front wall edge 49' of the bottom 7'. This compartment 2' can easily be placed between the thighs of the user on the surface on which the user sits. The interior angle β between the bottom 7' and the first side wall 6*a*' is indicated in FIG. 9.

A first lid part 8' extends in a manner similar to the transport box 1 of the first embodiment, pivotably from the top edge 10' of the first side wall 6*a*', a second lid part 9' extends pivotally from the opposite second side wall 6*b*' via top edge 11' so that these opposite first lid part 8' and second lid part 9' can be folded or pivoted away from each other to create the lap tray, thus obtaining a transformed state of the transport box 1'.

The second embodiment of the transport box 1' has no top walls extending into handle walls. Instead is provided a third lid part 107 extending pivotally from a top edge 108 of the rear wall 4', and a fourth lid part 109 extending pivotally from a top edge 110 of the front wall 5'.

The third lid part 107 has a first free handle end 111 with a handle opening 112 provided with a swing flap 113 hingedly connected to the perimeter of the handle opening 112 remote from the top edge 108.

The fourth lid part 109 has a respective second free handle end 114 with a handle opening 115, but without a flap.

In order to obtain an upright orientation of the first handle end 111 and the second handle end 114, at least in the transport state, the third lid part 107 and the fourth lid part 109 is provided with a thirty-second fold line 124 and a thirty-third fold line 125, respectively. The third lid part 107 can also be fastened to the waist of the jeans of a seated user in the transformed state. The thirty-second fold line 124 and the thirty-third fold line 125 also provide the effect that the first handle end 111 and the second handle end 114 are able to be folded or pivoted into a position where they, in the transport state, are folded/pivoted towards the lid 3', so that a number of transport boxes can be stacked on top of each other during e.g. transport, while the lid 3' is closed.

In the second embodiment 1' only the first lid part 8' has an upright rim 24*a*' that extends from the free edge 26' of the first lid part 8', where the interior angle α between the upright rim 24*a*' and the first lid part 8' is shown in FIG. 9. Since the design of the rim 24*a*' corresponds substantially to the upright rim 24*a* of the first embodiment of the transport box 1 this design will not be discussed further here. However the use of the rim 24*a*' is different in the transport state of the second embodiment of the transport box 1'.

When the second embodiment of the transport box 1' is closed to the transport state shown in FIG. 8 first the first lid part 8' is pivoted inside the compartment 2', so that its rim 24*a*' engages the interior surface of the compartment 2' or at least faces inside the cavity of said compartment 2'. Next the second lid part 9' is pivoted on top of the first lid part 8', and finally the opposite third lid part 107 and fourth lid part 109 are pivoted in superjacent proximity to each other so that the handle openings 112,115 of the respective handle ends 111,114 faces each other and the hinged flap 113 of the third lid part 107 can be pivoted inside the second handle opening 115 to interlock the third lid part 107 with the fourth lid part 109, so as to hold the first lid part 8' and the second lid part 9' in place to cover the opening 17' during transport, as seen in FIG. 8.

Figure 10:
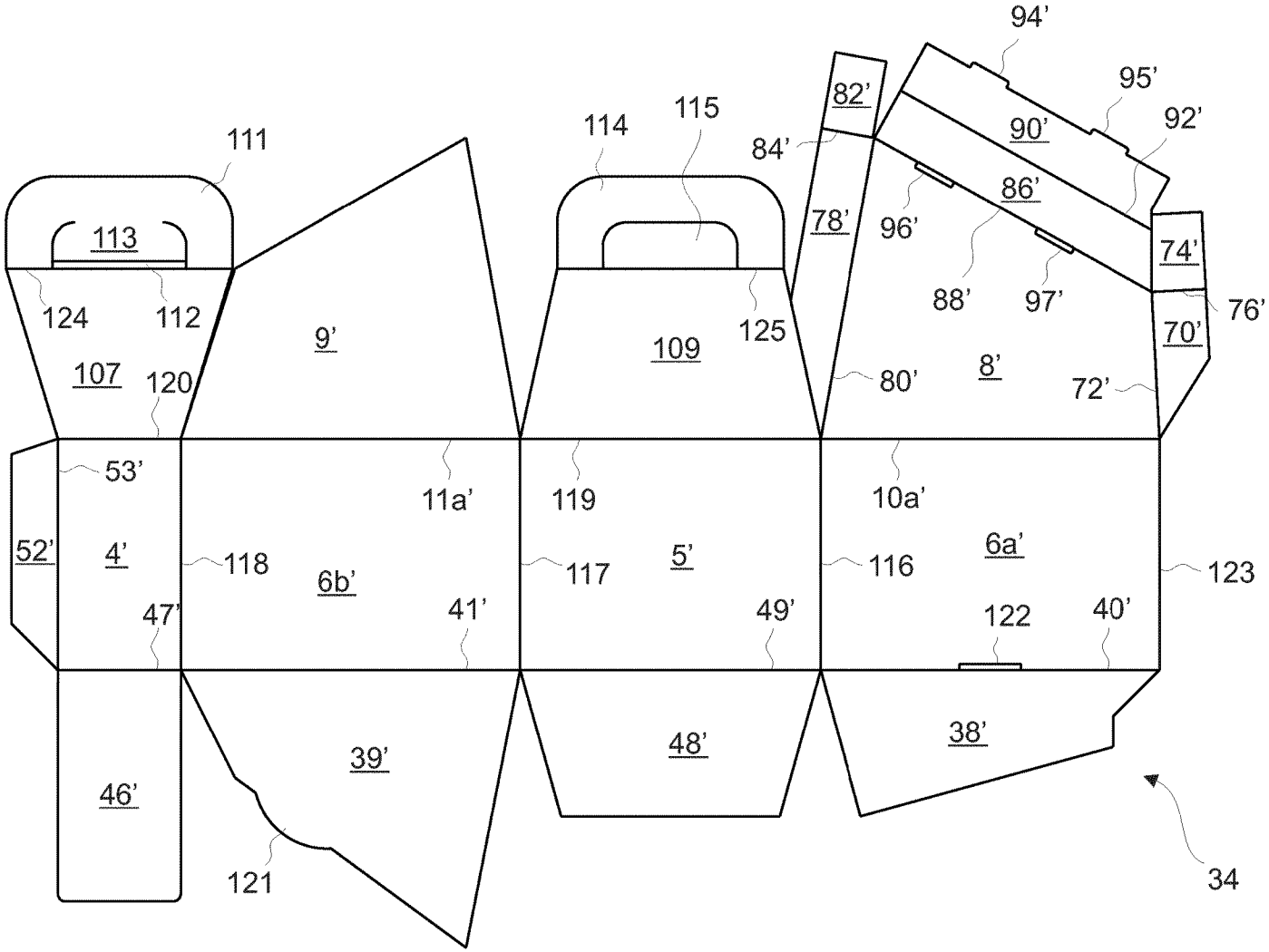
FIG. 10 shows a second embodiment of a first blank according to the invention.

FIG. 10 shows a second embodiment of the first blank 34' in its unfolded and flat state. To facilitate reading and understanding of the conversion of the blank into a transport box same reference numerals are used for same parts being walls in the three-dimensional state as for wall panels in the blank state where possible. The first side wall panel 6*a'* and the second side wall panel 6*b'* extend as panels into the front wall panel 5' via the opposite thirty-fourth fold line 116 and thirty-fifth second fold line 117, respectively. The rear wall panel 4' extends via the thirty-sixth fold line 118 into the second side wall panel 6*b'*.

The first bottom wall panel 38' and the second bottom wall panels 39' extend via the thirty-seventh fold line 40' and the thirty-eighth fold line 41', respectively, into the first side wall panel 6*a'* and the second side wall panel 6*b'*, respectively. The rear bottom wall panel 46' extends via the thirty-ninth fold line 47' into the rear wall panel 4' and the front bottom wall panel 48' extending via the fortieth fold line 49' into the front wall panel 5'.

The side wall panels 6*a'*,6*b'*, the rear wall panel 4' and the front wall panel 5', the bottom wall panels 38',39', the rear wall panel 46' and the front wall panel 48' are able to engage in an interlocking manner by means of e.g. glue. This can e.g.

be obtained by the following steps:

placing the front wall panel 48' on the first bottom wall panel 38' and gluing them together, placing the rear wall panel 46' on the front wall panel 48', placing the second bottom wall panel 39' on the rear wall panel 46', joining the second bottom wall panel 39' with the first side wall panel 6*a'* by inserting the small flap 121 into the correspondingly shaped cut-out hole 122 in the first side wall panel 6*a'*, and lastly gluing the first side wall panel 6*a'* and the flap 52' extending from the rear wall panel 4' together so that the compartment 2' shown in FIG. 8 is formed.

In this way the compartment 2' shown in FIG. 8 is formed, where it is noted that the first side wall panel 6*a'* and the flap 52' are glued together so that the edge 123 of the first side wall panel 6*a'* and the fortieth-first fold line 53' are aligned.

The first lid part panel 8' and the second 9' extend via the fortieth-second fold line 10*a'* into the first side wall panel 6*a'* and via the fortieth-third fold line 11*a'* into the second side wall panel 6*b'*, respectively.

The first lid part panel 8' has a rear flap 70' extending from the first lid part panel 8' via the fortieth-fourth fold line 72', where the rear flap 70' has a tuck-in tab 74' extending from the rear flap 70' via the fortieth-fifth fold line 76'. The first lid part panel 8' also has a front flap 78' extending from the first lid part panel 8' via the fortieth-sixth fold line 80', where the front flap 78' has a tuck-in tab 82' extending from the front flap 78' via the fortieth-seventh fold line 84'. Finally, the first lid part panel 8' has a first top flap 86' extending from the first lid part panel 8' via the fortieth-eighth fold line 88', where a second top flap 90' is extending from the first top flaps 86' via the fortieth-ninth fold line 92'.

The rim 24*a'* as shown in FIG. 9 is obtained by folding the flaps 70',78',86',90' and tuck-in tabs 74',82' in the same manner as described in connection with the first embodiment of the blank 34 (FIG. 6) by using the small flaps 94',95' of the second top flap 90' and the cut-out holes 96'97' of the first lid part panel 8' for interlocking the rear flap 70', front flap 78', first top flap 86', and second top flap 90'.

The third lid part panel 107 extend via the fiftieth fold line 120 into the rear wall panel 4' and has a first free handle end 111 defined by the thirty-second fold line 124. The fourth lid part panel 109 extend via the fiftieth fold line 120 into the front wall panel 5' and has a second free handle end 114 defined by the thirty-third fold line 125.

The releasable assembly of the first lid part panel 8', the second lid part panel 9', the third lid part panel 107 and the fourth lid part panel 109 is obtained as described in connection with FIGS. 8 and 9.

Figure 11:
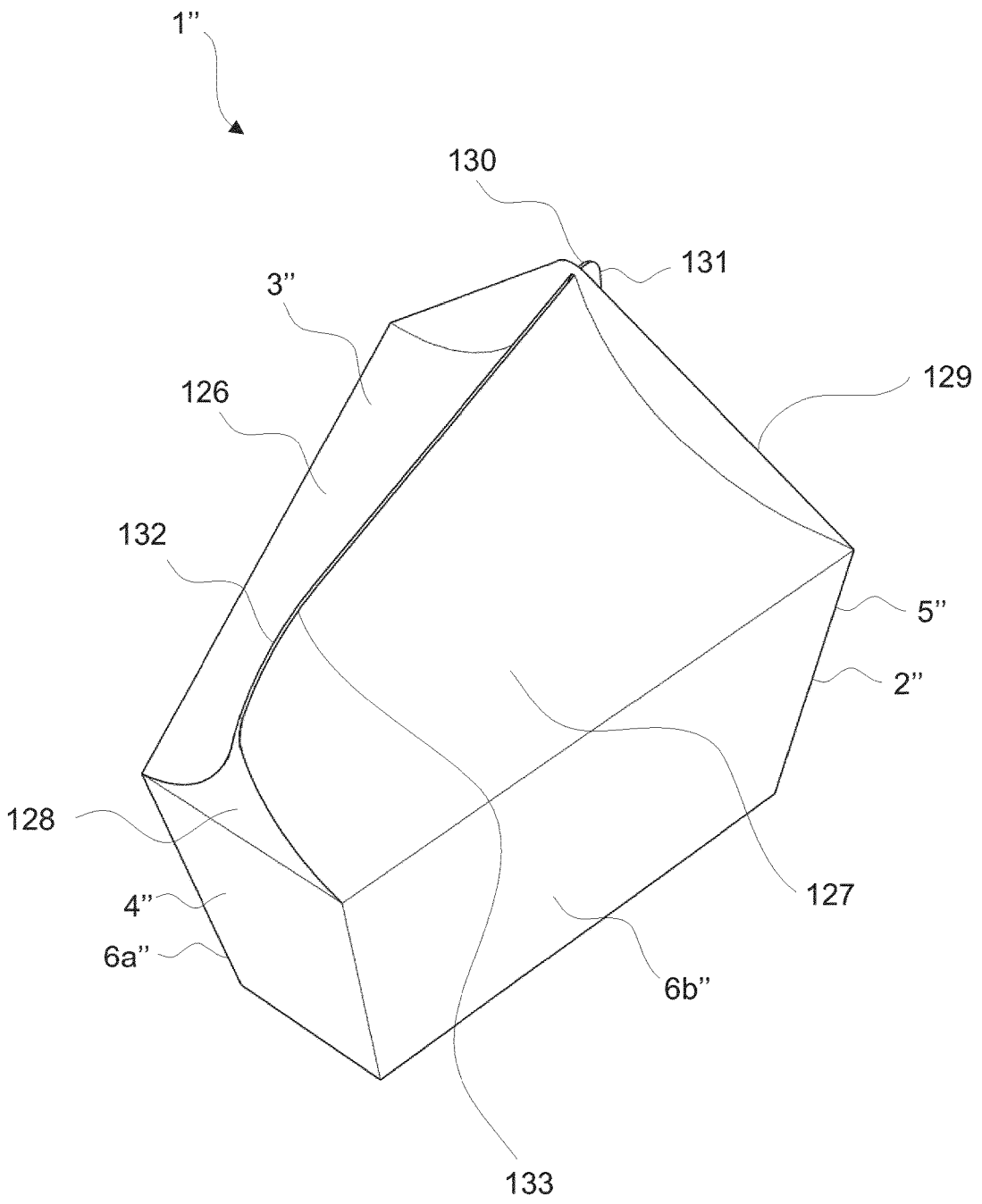
FIG. 11 shows, seen in perspective, a modified embodiment of the table box according to the present invention in its transport state.

FIG. 11 shows a modified embodiment of the table box 1" where the compartment 2" is constructed in the same way as the embodiments shown in FIGS. 1 and 8, where corresponding reference numbers are used for corresponding parts. The lid 3" has a first 126, second 127, third 128 and fourth 129 lid part extending from the upper edge of the first side wall 6*a"*, second side wall 6*b"*, front wall 5" and rear wall 4", respectively. The free upper front part 130 of the first lid part 126 and the free upper front part 131 of the second lid part 127 extend through the elongated through-going slit (not visible) of the fourth lid part 129, so that these three lid parts 126, 127, 129 are held together to serve as a handle. The curved first and second lid part 126, 127 are shaped so that the free upper edge 132, 133 of the first and second lid part 126, 127, respectively, are joined the length of the table box 1". The third lid part 128 is only partly visible in a horizontal position, where it covers the opening of the compartment 2".

The present inventions present a versatile selection of transport boxes that can be used as lap trays. The invention gives both manufacturer and user a high degree of freedom to combine and change features of the present invention to make user-friendly and environmentally friendly transport boxes.

Above are shown and described two embodiments for the first blank, where the individual panels are connected in different ways via fold lines and subsequently assembled to the three dimensional form of the transport box. It is understood that the panels of the first blank can be arranged in another pattern in order to obtain the flat configuration of the first blank.

What is claimed is:

1. A transport box configured for being transformable into a lap tray, the transport box comprising:

a compartment defined by opposite side walls, a front wall opposite a rear wall, and a bottom, with the walls delimiting an opening opposite the bottom for accessing the compartment;

the opening having a circumferential edge which is defined by opposite upper edges of the side walls, an upper edge of the rear wall and an upper edge of the front wall; and a lid for the opening comprising first and second lid parts which extends from and are pivotally connected to each respective side wall, wherein at least one of the first and second lid parts includes a rim extending along at least a portion of a free edge of at least one of the lid parts at a fixed angle $\alpha$ out of the plane of that lid part to help prevent objects from falling off the at least one lid part when opened and in use as a tray;

wherein:

the bottom has a front wall edge and a rear wall edge, which rear wall edge is shorter than the front wall edge;

the lid parts are configured to allow nesting of one lid part above the other lid part to close the compartment opening; and each lid part is configured for being folded or pivoted away from the opening in a transformed state of the transport box to serve as a lap tray;

wherein the compartment retains its shape whether configured as a transport box or as a lap tray.

2. The transport box according to claim 1, wherein at least a part of the respective opposite faces of the respective opposite side walls diverge in the direction from the rear wall to the front wall.

3. The transport box according to claim 1, wherein the lid comprises a third lid part extending from the upper edge of the rear wall opposite a fourth lid part extending from the upper edge of the front wall.

4. The transport box according to claim 1, wherein the shape of the bottom is or appears substantially as a trapezoid or isosceles trapezoid.

5. The transport box according to claim 1, wherein a cross-section of the compartment in a plane parallel to the bottom has a substantially trapezoidal or isosceles trapezoidal shape.

6. The transport box according to claim 3, wherein the angle $\alpha$ that extends out of the plane of the lid part is an angle of 90°+/−20°.

7. A transport box configured for being transformable into a lap tray, the transport box comprising:

a compartment defined by opposite side walls, a front wall opposite a rear wall, and a bottom, with the walls delimiting an opening opposite the bottom for accessing the compartment, the opening having a circumferential edge which is defined by opposite upper edges of the side walls, an upper edge of the rear wall and an upper edge of the front wall, and a lid for the opening comprising at least one lid part, wherein a first of the at least one lid part has free edges and extends from the circumferential edge of the opening, and wherein the first lid part extends from a side wall and includes a rim extending from at least a part of a free edge of the first lid part at an angle $\alpha$ out of the plane of the lid part to prevent objects from falling off the at least one lid part, wherein:

the bottom has a front wall edge and a rear wall edge, which rear wall edge is shorter than the front wall edge, and the first lid part is configured for being folded or pivoted away from the opening in a transformed state of the transport box to serve as a lap tray;

wherein the compartment retains its shape whether configured as a transport box or as a lap tray, wherein the lid comprises at least a second lid part, where the at least one first lid part and the second lid part extend from different edge parts of the circumferential edge of the opening, and a third lid part extending from the upper edge of the rear wall opposite a fourth lid part extending from the upper edge of the front wall, wherein one of the third lid part or the fourth lid part has an opening with a hinged flap and the opposite lid part has an opening for interlocking with the hinged flap in a transport state of the transport box.

8. The transport box according to claim 1, wherein the transport box is collapsible from a three-dimensional configuration into a flattened configuration.

9. The transport box according to claim 1, wherein each of the first and second lid parts are configured to conform in shape to the compartment opening.

10. The transport box according to claim 1, wherein one of the lid parts has dimensions that are slightly smaller than that of the other lid part.

11. The transport box according to claim 1, wherein each of the first and second lid part includes a rim extending along the entire length of each free edge.

12. A transport box configured for being transformable into a lap tray, the transport box comprising:

a compartment defined by opposite side walls, a front wall opposite a rear wall, and a bottom, with the walls delimiting an opening opposite the bottom for accessing the compartment;

the opening having a circumferential edge which is defined by opposite upper edges of the side walls, an upper edge of the rear wall and an upper edge of the front wall; and a lid for the opening comprising first and second lid parts that extends from and is pivotally connected to each their side wall, and wherein at least one of the first and second lid parts includes a rim extending along at least a portion of a free edge of the at least one lid part at a fixed angle $\alpha$ of 90°+/−20° out of the plane of the lid part;

wherein:

the bottom has a front wall edge and a rear wall edge, which rear wall edge is shorter than the front wall edge;

the lid parts are configured to allow nesting of one lid part above the other lid part to close the compartment opening;

each of the first and second parts are configured for being folded or pivoted away from the opening in a transformed state of the transport box to serve as a lap tray, where the rim of the at least one lid part helps preventing objects from falling off the at least one lid part;

each of the first and second lid parts are configured to conform in shape to the compartment opening with one of the lid parts having dimensions that are slightly smaller than that of the other lid part;

the bottom has a shape that is a trapezoid or isosceles trapezoid; and the compartment retains its shape whether configured as a transport box or as a lap tray.

13. The transport box according to claim 12, wherein each of the first and second lid part includes a rim extending along the entire length of each free edge to further help preventing objects from falling off the lid parts in the lap tray configuration.

* * * * *